US006536447B1

(12) United States Patent
Fioravanti et al.

(10) Patent No.: US 6,536,447 B1
(45) Date of Patent: Mar. 25, 2003

(54) COSMETIC COMPACT

(75) Inventors: Alex Fioravanti, Bensalem, PA (US); Christopher Paul Ramsey, Oxfordshire (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/868,986

(22) PCT Filed: Nov. 26, 1999

(86) PCT No.: PCT/GB99/03928

§ 371 (c)(1),
(2), (4) Date: Jun. 22, 2001

(87) PCT Pub. No.: WO00/38554

PCT Pub. Date: Jul. 6, 2000

(30) Foreign Application Priority Data

Dec. 23, 1998 (GB) ..... 9828332

(51) Int. Cl.[7] ..... A45D 33/02
(52) U.S. Cl. ..... 132/299
(58) Field of Search ..... 132/299, 298, 132/295; 206/581, 823; 222/207, 212, 209, 632, 444; 401/184, 185, 186

(56) References Cited

U.S. PATENT DOCUMENTS

| | | | | | |
|---|---|---|---|---|---|
| 1,580,690 | A | * | 4/1926 | Sierad et al. | 222/207 |
| 1,608,449 | A | * | 11/1926 | Wendel | 132/299 |
| 1,694,727 | A | * | 12/1928 | Allen | 132/299 |
| 1,780,736 | A | | 11/1930 | Bassett | |
| 1,816,241 | A | | 7/1931 | Weeks | |
| 1,956,991 | A | * | 5/1934 | Lowen | 132/299 |
| 2,259,240 | A | * | 10/1941 | Chambers | 132/299 |
| 2,554,489 | A | * | 5/1951 | Crane | 132/299 |
| 3,199,743 | A | * | 8/1965 | Berger | 132/298 |
| 4,982,751 | A | | 1/1991 | Oishi et al. | |
| 5,115,930 | A | | 5/1992 | Lohrman et al. | |
| 5,197,637 | A | * | 3/1993 | Naumann | 222/207 |

FOREIGN PATENT DOCUMENTS

| | | |
|---|---|---|
| EP | 0 528 705 A1 | 2/1993 |
| EP | 0 790 017 A1 | 8/1997 |
| FR | 769 203 | 5/1933 |
| FR | 2 637 871 A1 | 10/1988 |
| GB | 281 681 | 11/1927 |
| GB | 436 112 | 12/1934 |
| GB | 468 029 | 12/1936 |
| GB | 514 844 | 5/1938 |
| GB | 647 146 | 12/1950 |
| GB | 798 338 | 7/1958 |
| GB | 2 297 959 A | 2/1996 |
| JP | 08104994 | 11/1997 |

* cited by examiner

*Primary Examiner*—Todd E. Manahan
(74) *Attorney, Agent, or Firm*—Diller, Ramik & Wight

(57) ABSTRACT

A dispensing container includes a sealed compartment closed by a moveable panel having a dispensing aperture therein and a dispensing tube depending therefrom. The moveable panel, dispensing aperture and tube are of an integral homogeneous single piece construction of molded material which effects dosing absent complicated conventional valving and reduces both production and consumer costs.

22 Claims, 4 Drawing Sheets

COSMETIC COMPACT

BACKGROUND OF THE INVENTION

This invention relates to cosmetic compacts and in particular to compacts providing an airtight compartment for a cosmetic preparation, to prevent it from drying out or ageing due to contact with air.

Compact cases have long been used for enclosing various cosmetic preparations such as powder, blushers, facial creams and the like. These cases are generally small, portable containers designed to fit in a handbag or purse. A problem with such compact cases has been their general inability to prevent the cosmetic preparation within the container from drying out, caking or seeping.

This problem has been addressed in U.S. Pat. No. 4,586,519 and JP 09285336A, by providing an annular cover as an additional airtight sealing member between the cosmetic preparation and the hinged lid of the compact. However, in this arrangement, the cosmetic preparation is still exposed to the air every time the compact is opened for use. DE 4,321,568 and U.S. Pat. No. 4,795,063, provide an enhanced compact design, in which the compact is provided with a sealed compartment from which the cosmetic preparation is dispensed by a dosing mechanism. The dosing mechanisms described rely on a permanent volume change of the sealed compartment to dispense the required dose of cosmetic preparation. A disadvantage of such arrangements is that they require movement of a part of the sealed compartment wall, which makes it more difficult to provide an adequate air tight seal. In U.S. Pat. No. 4,795,063, this sealing problem is overcome by providing the cosmetic preparation within a sealed bag which is compressed by a moveable plate. However, this arrangement is complex and requires significant assembly. Finally, in both these arrangements, it is difficult to ensure that all the cosmetic preparation is dispensed from the sealed compartment by the dosing mechanism.

SUMMARY OF THE INVENTION

Accordingly, the present invention provides a cosmetic compact comprising a body, which defines a sealed compartment for a cosmetic preparation; a dispensing aperture, in fluid communication with the sealed compartment; and a dosing mechanism for transferring a dose of the cosmetic preparation from the sealed compartment through the dispensing aperture; characterised in that the dosing mechanism comprises a moveable panel having a stable, normal position and an unstable dosing position, wherein movement of the moveable panel from its normal position to its dosing position pressurises the sealed compartment, forcing a dose of the cosmetic preparation through the dispensing aperture and thereafter, the moveable panel returns to its stable, normal position as air enters the sealed compartment through the dispensing aperture.

In this arrangement, the cosmetic preparation is constrained in a generally air tight manner within the sealed compartment. The dosing mechanism is arranged to dispense a dose of the cosmetic preparation by pressurising the contents of the sealed compartment. The cosmetic preparation dispensed from the sealed compartment is replaced by air, which is drawn into the sealed compartment via the dispensing aperture, thereby relieving the internal pressure. In this arrangement, the volume of the sealed compartment returns to its original value after each dispensing operation. This contrasts with the prior art arrangements discussed above, where the dispensing aperture acts as a one-way valve and the sealed compartment therefore, reduces in volume as its contents are dispensed.

Preferably, the sealed compartment is not filled with the cosmetic preparation, leaving a headspace above the surface of the cosmetic preparation. The dosing mechanism dispenses the cosmetic preparation from the sealed compartment by pressurising the headspace, which forces the cosmetic preparation through the dispensing aperture. However, it will be appreciated that the sealed compartment may initially be filled with cosmetic preparation, in which case, the first few doses of cosmetic preparation may be dispensed, before the air can enter the sealed compartment. Once the air enters the sealed compartment, a headspace will form above the cosmetic preparation and thereafter, the dosing mechanism will operate by pressurising the headspace, as described above.

The dosing mechanism comprises a moveable panel, which has a normal, stable position. The panel is arranged so that it can be depressed by a user of the compact, to dispense a dose of the cosmetic preparation. However, the panel is designed to be unstable in this depressed, dosing position and tries to return to its normal, stable position as soon as it is released by the user. Thus, once the user releases the panel, it returns to its stable, normal position, drawing air through the dispensing aperture to replace the cosmetic preparation dispensed.

An advantage of this arrangement is that when the level of cosmetic preparation within the sealed compartment is low, the moveable panel can still dispense the cosmetic preparation by pressurising the headspace within the sealed compartment rather than by acting on the cosmetic preparation directly. This allows more of the cosmetic preparation to be dispensed from the sealed compartment.

Preferably, the dosing mechanism also comprises a tube, having an open, outlet end, connected to the dispensing aperture, and an open inlet end arranged towards the base of the sealed compartment. Cosmetic preparation is drawn from the bottom of the sealed compartment, through the inlet end of the tube as the headspace within the sealed container is pressurised by depression of the moveable panel. This arrangement ensures that as the cosmetic preparation is consumed, the tube inlet remains submerged in the cosmetic preparation, thereby ensuring that a fluid connection is always maintained between the cosmetic preparation and the dispensing aperture. This prevents air bubbles being entrained in the cosmetic preparation as it is dispensed, thereby preventing splattering of the product.

Advantageously, the cosmetic compact according to the invention also comprises a lid which co-operates with the body between open and closed positions. The lid may be connected to the body by a hinge. A catch may be provided to hold the lid in its closed position with respect to the body. The lid ensures that the moveable panel is not accidentally depressed, spilling the cosmetic preparation, whilst the compact is being carried in a handbag or the like.

Conveniently, a sealing means is also provided to close the dispensing aperture when the compact is not in use. The sealing means ensures that the cosmetic preparation is not accidentally spilled from the sealed compartment and also that the cosmetic preparation adjacent to the dispensing aperture does not dry out or age due to contact with air. Where the compact is provided with a lid, the sealing means preferably comprises a projection located on the lid and adapted to seal the dispensing aperture when the body and lid of the compact are in their closed position.

In an alternative embodiment of the invention, the compact may be provided without a lid, as a low cost compact or as a replacement cartridge for a separate cosmetic compact case. In this embodiment, the sealing means may be provided by a plug, connected to the body of the cosmetic compact, and adapted to seal the dispensing aperture. Where the compact is provided as a cartridge, the plug may be connected to the body of the compact by frangible bridges so that the plug can be torn away from the body when the cartridge is inserted into a cosmetic compact case.

In one embodiment of the invention, the body of the cosmetic compact is provided by a base and a separate cover which are held in sealing engagement by a bore seal. Conveniently, the moveable panel is located in the cover. The moveable panel may either be provided as a portion of the cover or may extend across the whole surface of the cover. It will be appreciated that the moveable panel could equally be located on the base or sides of the compact. However, where the panel is provided as the whole or part of a separate component which has to be sealed to the remainder of the compact body, it is preferable for the seal to be located above the level of the cosmetic preparation when the compact is in an upright orientation. This ensures that the seal is not immersed in the cosmetic preparation during storage and transportation, reducing the risk of leaks.

Preferably, the moveable panel takes the form of a flexible diaphragm. The diaphragm is adapted to elastically extend when depressed by the user of the compact. Once the user releases the diaphragm, its inherent elasticity urges it to return to its normal, non-extended position. Hence, a flexible diaphragm has the inherent self-return property, required by the invention.

According to one convenient arrangement, the cosmetic compact is provided with a dosing recess adapted to receive the dose of cosmetic preparation dispensed through the dispensing aperture. The dispensing aperture is preferably located within the dosing recess. In this arrangement, the dosing recess constrains the cosmetic preparation once it has been dispensed through the dispensing aperture, making it more accessible to the user of the compact.

In another embodiment of the invention, the compact comprises a base into which a sealed bottle is clipped. The sealed bottle has a dispensing aperture and defines the airtight compartment for the cosmetic preparation. The moveable panel is located on the bottle so that it is accessible to the user of the compact. Preferably, the bottle is made of a flexible material and the moveable panel is provided by a side wall of the bottle which can be depressed by the user of the compact to dispense a quantity of the cosmetic preparation. The bottle may be sealed by a conventional closure. It will be appreciated that rather than providing a separate base and bottle, the base may be moulded integrally with the bottle. Finally, as discussed above, a lid may be provided to cover the body of the compact. The lid may be hinged to the base of the compact or the bottle, as appropriate.

BRIEF DESCRIPTION OF THE DRAWINGS

The invention will now be described, by way of example only, with reference to the accompanying drawings, in which.

DESCRIPTION OF THE PREFERRED EMBODIMENTS

Figure 1:
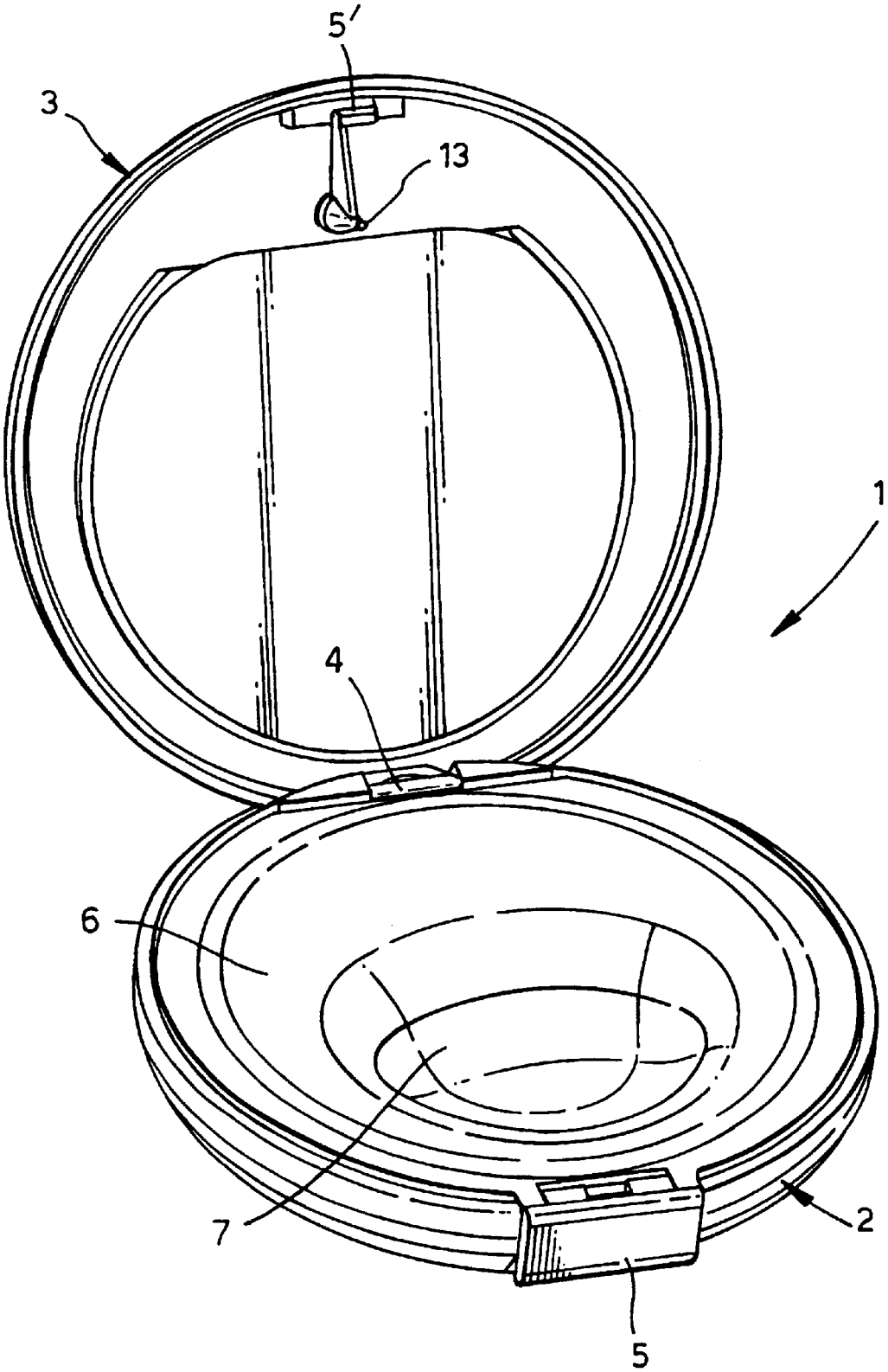
FIG. 1 shows an isometric view of a cosmetic compact according to the present invention.
Figure 2:
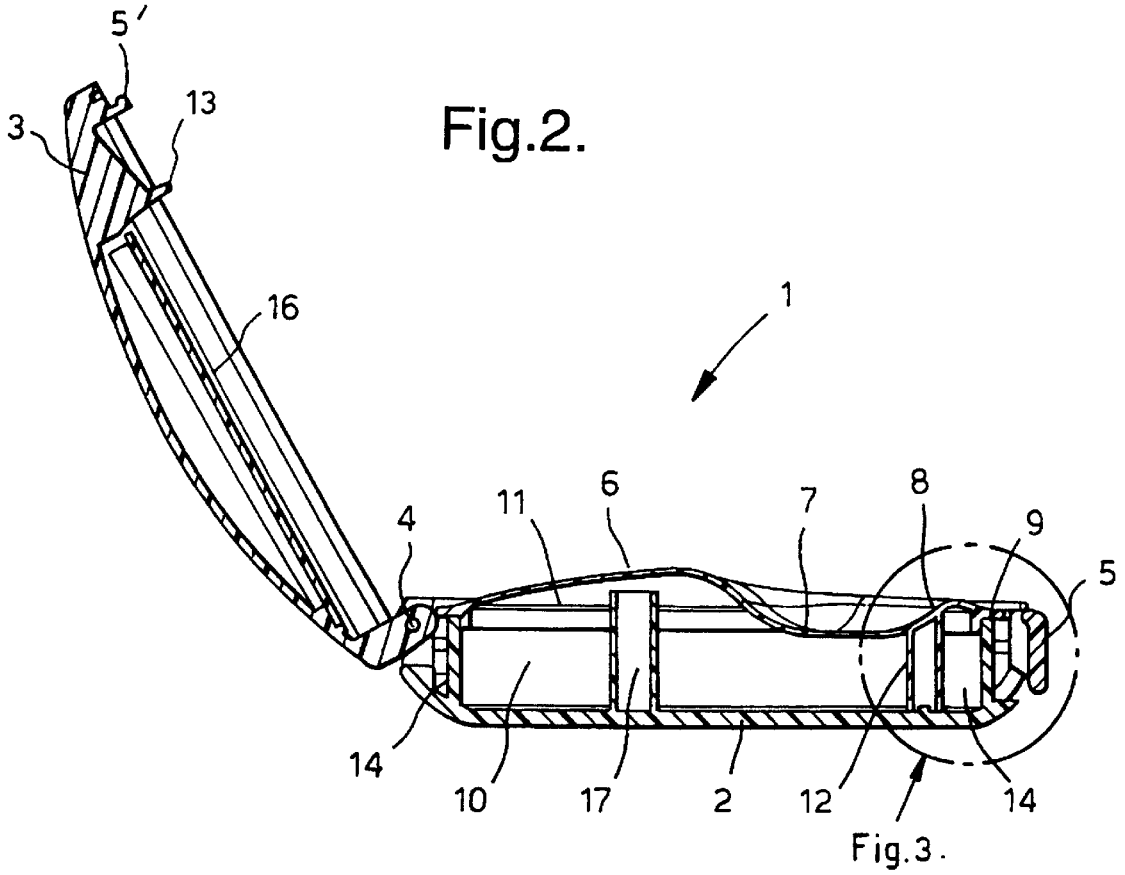
FIG. 2 shows a side section view through the centre of the compact shown in FIG. 1.
Figure 3:
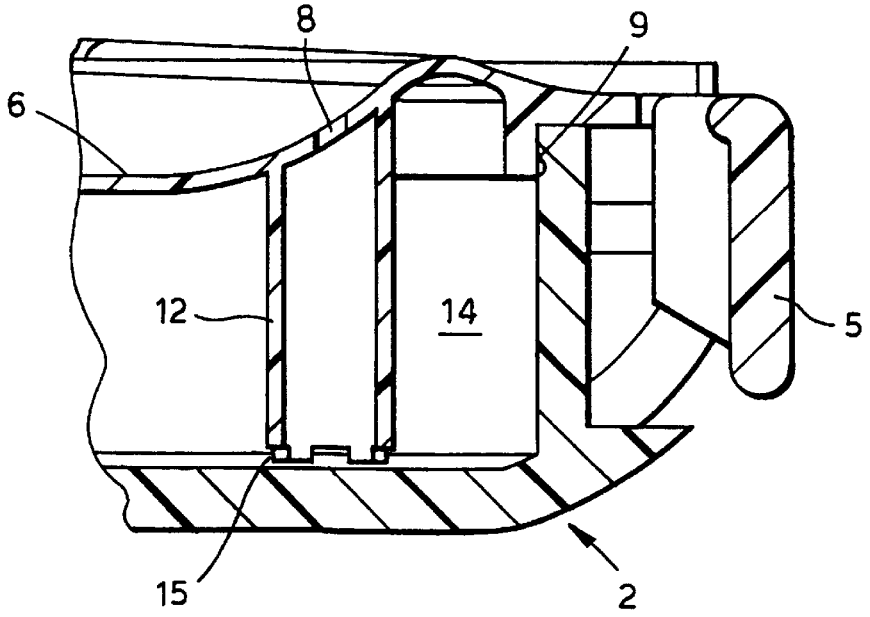
FIG. 3 shows an enlarged portion of FIG. 2 around the dispensing aperture.

Referring to FIGS. 1 to 3, the cosmetic compact (shown generally at 1) comprises a base 2 and a lid 3 pivotally connected to one another by means of a hinge 4. Opposite the hinge 4, catch members 5, 5' are provided on the base 2 and lid 3 respectively, to secure the compact in its closed position.

Received in the base 2 is a dividing cover 6 which includes a flexible portion which acts as a diaphragm. The dividing cover 6 also includes a dosing recess 7 within which is a dispensing aperture 8, typically of the order of 1 mm in diameter. The dividing cover 6 is held in sealing engagement with the base 2 by means of a bore seal 9. The base 2 and the dividing cover 6 define a sealed compartment 14 within the periphery of the bore seal 9, in which a cosmetic preparation 10 may be constrained in a generally air tight manner. The cosmetic preparation 10 is provided within the sealed compartment 14, leaving a headspace 11 above the surface of the cosmetic preparation. A tube 12, open at both ends, is provided with an outlet end in fluid connection with the dispensing aperture 8 and an inlet end 15, located towards the base of the sealed compartment (as shown in FIGS. 2 and 3). The inlet end 15 of the tube is located towards the base of the sealed compartment 14 to ensure that it remains submerged in the cosmetic preparation, as the sealed compartment empties.

The lid 3 includes a projection 13 adapted to enter the dispensing aperture 8 and seal it when the cover 3 is latched closed with respect to the base 2 by means of the latch 5, 5'. The lid 3 may include a mirror 16 to aid the user in the application of the cosmetic preparation.

In use, the cosmetic compact 1 is opened by the user, who depresses the flexible portion of the cover 6 into the sealed compartment 14. This pressurises the headspace 11 above the surface of the cosmetic preparation 10 which forces a quantity of the cosmetic preparation from the base of the sealed compartment 14, through the inlet 15 and up the tube 12 to the dispensing aperture 8. A stop or detent 17 (shown in FIG. 2) may be provided to limit the extent of travel of the flexible portion of the cover 6, so that too much product is not dispensed in one dose. Once the cosmetic preparation is forced through the dispensing aperture 8, it is constrained within the dosing recess 7 where it is accessible to the user of the compact. The cosmetic preparation may then be applied by the user using a finger, pad or other applicator. The cover 6 may include a recess (not shown) in which a suitable applicator or pad is provided.

Once the user releases the flexible portion of the cover 6, it returns to its normal, stable position, drawing air through the aperture 8 and the tube 12, to replace the cosmetic preparation dispensed and thereby balance the pressure in the headspace with that outside the compact.

Figure 4:
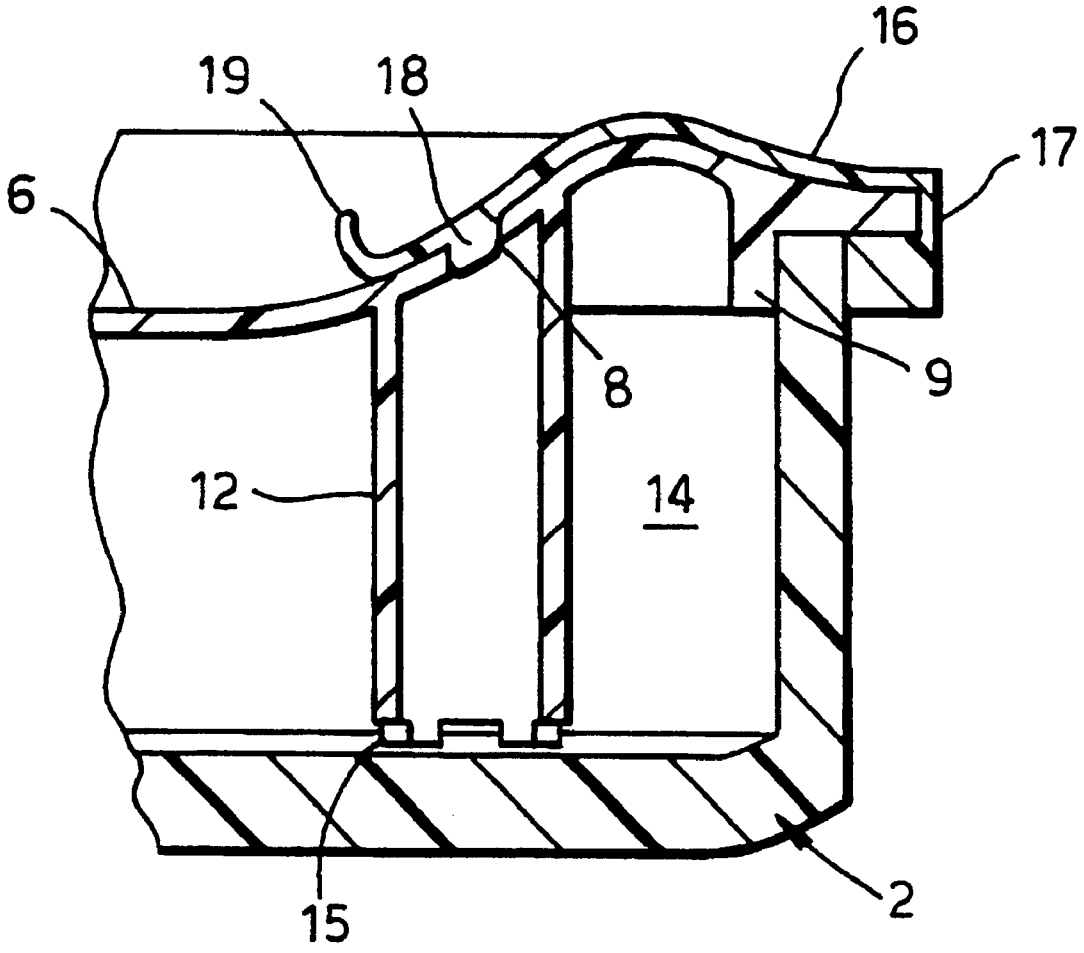
FIG. 4 shows a partial section view of a second embodiment of the invention around the dispensing aperture.

FIG. 4 shows a second embodiment of the invention in which the compact is provided as a refill cartridge for insertion in a separate cosmetic compact case. Like components have been given the same reference numerals as in the previous figures. The compact cartridge comprises a base 2 and a cover 6 which are sealably connected by a bore seal 9. Together, the base 2 and cover 6 define a sealed compartment 14 within the periphery of the bore seal 9. The sealed compartment 14 is suitable for storing a cosmetic preparation in a substantially airtight condition. As previously described, the compact cartridge comprises a tube 12 having an inlet 15 arranged towards the base of the sealed compartment 14 and an outlet in fluid communication with a dispensing aperture 8. A sealing cover 16 is connected to the base 2 by frangible bridges 17. The sealing cover 16 includes a plug 18 adapted to enter and thereby seal the dispensing aperture 8. A tongue 19 is provided on the sealing cover 16 to assist in removal of the plug 18 from the dispensing aperture 8.

When the cartridge is inserted into a separate cosmetic compact case (not shown), the sealing cover 16 may be torn away from the remainder of the cartridge at the frangible bridges 17. Alternatively, the frangible bridges 17 may be replaced by a film hinge. In this arrangement, the sealing cover may be folded out of the way, about the film hinge, when the compact is being used but may be replaced to seal the dispensing aperture 8 when the compact is in use. In this arrangement, the cover and the base may be moulded as a single item, which is then folded to assemble the sealed compartment. The sealing cover 16 may also be formed integrally with the cover and base and folded to seal the dispensing aperture.

Figure 6:
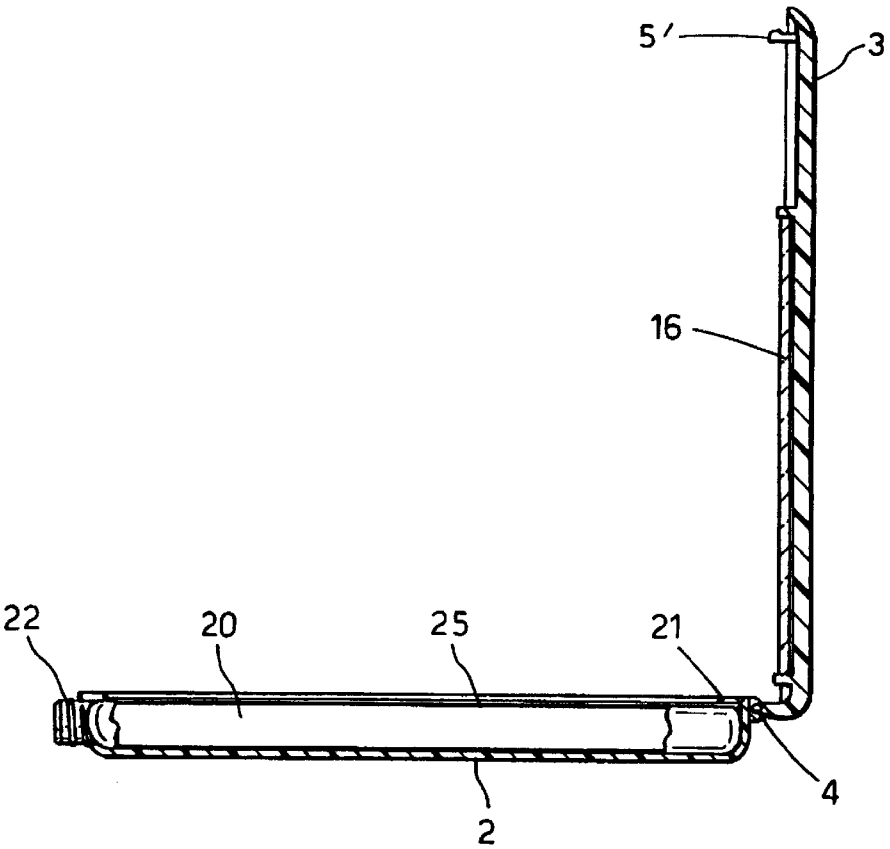
FIG. 6 shows a side section view through the centre of the compact shown in FIG. 5.
Figure 5:
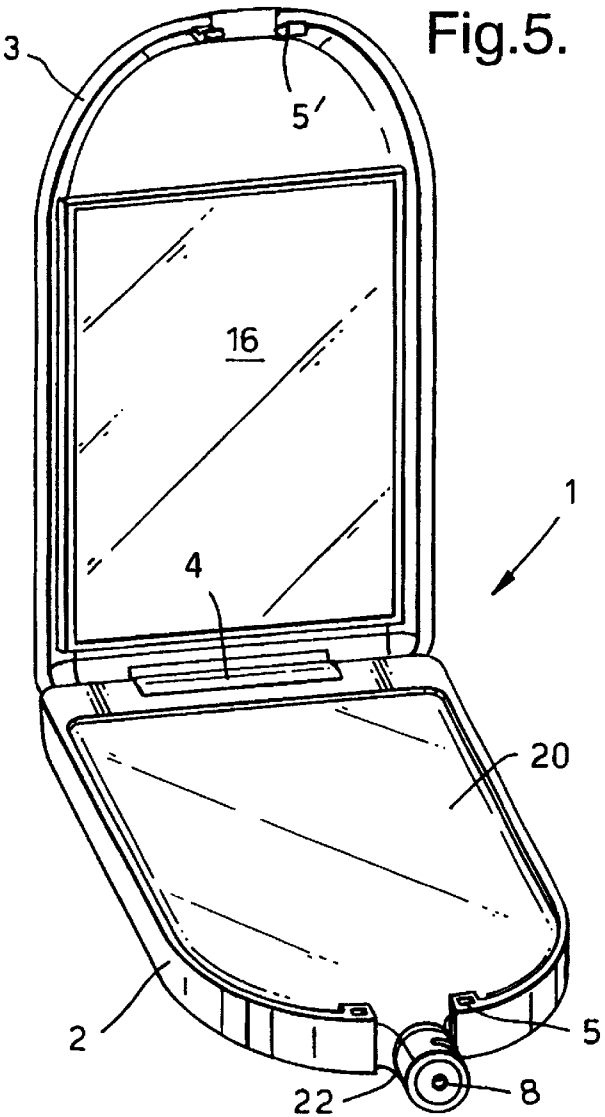
FIG. 5 shows an isometric view of a third embodiment of a cosmetic compact according to the invention, comprising a bottle and compact case.

FIGS. 5 and 6 show a third embodiment of the invention in which the sealed compartment and associated dispensing aperture are provided by a bottle which is adapted to fit into a cosmetic compact case. Like components have been given the same reference numerals as in the previous figures.

The cosmetic compact (generally indicated at 1) comprises a base 2 and a lid 3, which are pivotally connected by means of a hinge 4. Opposite the hinge 4, catch members 5, 5' are provided on the base 2 and lid 3 respectively to secure the compact case in its closed position. A bottle 20 is adapted to fit into the base 2. The bottle 20 provides a sealed compartment for a cosmetic preparation. A dispensing aperture 8 is provided in the bottle through which the cosmetic preparation may be dispensed. The bottle 20 may be sealed using a conventional closure. For example, a finish portion on the bottle may extend through the side of the compact base 2 (as shown in FIG. 5) and may be provided with a helical thread 22 which is arranged to co-operate with the thread on a closure (not shown). The closure is arranged to seal the dispensing aperture 8.

The base 2 is provided with a retaining lip 21 and the bottle 20 is designed so that it can slide under the lip 21, such that it is firmly retained within the base. Preferably, the side wall 25 of the bottle (accessible to the user of the compact) is sufficiently flexible, or has a flexible portion, such that the flexible portion 25 of the bottle 20 can be depressed to dispense a quantity of cosmetic preparation. Finally, a mirror 16 may be provided in the lid 3 of the compact to assist a user in applying the cosmetic preparation.

It will be apparent that other configurations are possible without departing from the general scope of the invention. For example, whilst the dosing mechanism has been described as including a flexible diaphragm, different designs of moveable panel, having the self return property required by the invention, are possible.

Although a preferred embodiment of the invention has been specifically illustrated and described herein, it is to be understood that minor variations may be made in the apparatus without departing from the spirit and scope of the invention, as defined the appended claims.

What is claimed is:

1. A cosmetics container comprising a body defining a sealed compartment for a cosmetic preparation; a dosing mechanism including a dispensing aperture in fluid communication with the sealed compartment, said dosing mechanism being operative for transferring a dose of the cosmetic preparation from the sealed compartment through the dispensing aperture, the dosing mechanism including a movable panel having a stable normal position and an unstable dosing position whereby movement of the movable panel from its normal position to its dosing position pressurizes the sealed compartment forcing a dose of the cosmetic preparation through the dispensing aperture and thereafter the moveable panel returns to its stable normal position as air enters the sealed compartment through the dispensing aperture, the dosing mechanism further including a tube located within the sealed compartment having an inlet arranged towards a base of the sealed compartment and an outlet at the dispensing aperture, the dispensing aperture and tube being defined by said moveable panel; and said moveable panel, dispensing aperture and tube being an integral substantially homogenous single piece of molded material.

2. The cosmetics container according to claim 1 wherein a headspace is left above a cosmetic preparation in the sealed compartment, and the movement of the moveable panel from its normal position to its dosing position pressurizes the headspace thereby forcing the cosmetic preparation through the tube through the dispensing aperture.

3. The cosmetics container according to claim 2, further comprising a sealing means adapted to seal the dispensing aperture.

4. The cosmetics container according to claim 1, further comprising a lid arranged to co-operate with the body between open and closed positions.

5. The cosmetics container according to claim 4 wherein the lid includes a projection, and the projection is arranged to seal the dispensing aperture when the lid and body are in their closed position.

6. The cosmetics container according to claim 1 wherein the body comprises a base and a cover, and the base and cover are arranged in sealing engagement to provide the sealed compartment therebetween.

7. The cosmetics container according to claim 6 wherein the sealing engagement between the base and the cover is provided by a bore seal.

8. The cosmetics container according to claim 7, wherein the movable panel forms part or the whole of the cover.

9. The cosmetics container according to claim 6 wherein the dispensing aperture is located in the cover.

10. The cosmetics container according to claim 6, wherein the movable panel forms part or the whole of the cover.

11. The cosmetics container according to claim 1, further comprising a dosing recess adapted to receive the dose of cosmetic preparation dispensed through the dispensing aperture.

12. The cosmetics container according to claim 11 wherein the dispensing aperture is located within the dosing recess.

13. The cosmetics container according to claim 1, further comprising a sealing means adapted to seal the dispensing aperture.

14. The cosmetics container according to claim 1, wherein the movable panel comprises a flexible diaphragm.

15. The cosmetics container as defined in claim 1 wherein the dosing mechanism transfers a dose of the cosmetic preparation absent conventional moveable valving.

16. The cosmetics container as defined in claim 1 wherein the dosing mechanism transfers a dose of the cosmetic preparation absent conventional moveable valving associated with said tube.

17. The cosmetics container as defined in claim 1 wherein said moveable panel includes a panel portion spanning an upper end of said tube, said dispensing aperture is in said panel portion, and said tube includes an upper end surrounding said dispensing aperture.

18. The cosmetics container as defined in claim 17 wherein the dosing mechanism transfers a dose of the cosmetic preparation absent conventional moveable valving.

19. The cosmetics container as defined in claim 17 wherein the dosing mechanism transfers a dose of the cosmetic preparation absent conventional moveable valving associated with said tube.

20. The cosmetics container as defined in claim 17 wherein said tube includes a lower end, and said tube lower end includes means for conducting a cosmetic preparation from the sealed compartment into the tube.

21. The cosmetics container as defined in claim 18 wherein said tube includes a lower end, and said tube lower end includes means for conducting a cosmetic preparation from the sealed compartment into the tube.

22. The cosmetics container as defined in claim 19 wherein said tube includes a lower end, and said tube lower end includes means for conducting a cosmetic preparation from the sealed compartment into the tube.

* * * * *